US009711068B2

(12) United States Patent
St. Denis

(10) Patent No.: US 9,711,068 B2
(45) Date of Patent: Jul. 18, 2017

(54) WARNING SIGN

(76) Inventor: Dennis St. Denis, Cornwall (CA)

( * ) Notice: Subject to any disclaimer, the term of this patent is extended or adjusted under 35 U.S.C. 154(b) by 635 days.

(21) Appl. No.: 13/066,208

(22) Filed: Apr. 7, 2011

(65) Prior Publication Data

US 2012/0047784 A1 Mar. 1, 2012

(30) Foreign Application Priority Data

Aug. 25, 2010 (CA) ..... 2713432

(51) Int. Cl.
*G09F 7/00* (2006.01)
*G09F 7/18* (2006.01)
*G09F 19/22* (2006.01)

(52) U.S. Cl.
CPC ..... *G09F 7/18* (2013.01); *G09F 19/22* (2013.01)

(58) Field of Classification Search
None
See application file for complete search history.

(56) References Cited

U.S. PATENT DOCUMENTS

| | | | | |
|---|---|---|---|---|
| 81,490 | A | 8/1868 | Gibson, Jr. | |
| 790,098 | A | 5/1905 | Baird | |
| 1,379,438 | A | 5/1921 | Billings | |
| 3,795,983 | A | 3/1974 | Gallagher | |
| D362,690 | S | 9/1995 | Perreault | |
| 5,842,811 | A | 12/1998 | Johnson | |
| 6,371,692 | B1 | 4/2002 | Fatigati | |
| 6,425,212 | B1 * | 7/2002 | Lovazzano | 52/105 |
| 6,615,522 | B1 | 9/2003 | Weis | |
| 7,219,458 | B2 | 5/2007 | Burlando | |
| 7,497,025 | B2 * | 3/2009 | Murray | 33/528 |

* cited by examiner

*Primary Examiner* — Joanne Silbermann

(57) ABSTRACT

A warning sign for attachment to a load bearing wall in a building, the wall having an inner supporting structure covered with an outer layer. The sign is mountable on the supporting structure of the wall before the structure is covered with the outer layer of material so that the sign is not normally visible. The sign becomes visible only on removal of the outer layer such as during renovation. The sign has a message on its side facing outwardly from the structure, when the sign is attached to the structure, to warn a person viewing the sign when the sign is visible. The message warns the viewer that the wall is a load bearing wall and that the removal of the wall could have dangerous consequences.

The invention is also directed toward a load bearing wall incorporating the sign and the use of the sign in a load bearing wall.

6 Claims, 2 Drawing Sheets

WARNING SIGN

BACKGROUND OF THE INVENTION

1. Technical Field

This invention relates to a warning sign. The invention is also directed toward a load bearing wall in a building provided with the warning sign and to the use of the sign in the wall.

2. Background Art

Some people, who do their own renovating, are not aware that some walls in buildings, particularly interior walls, are load bearing, the load bearing walls being used to support structure above them. When they tear down a load bearing wall during renovations to provide open space, or for other reasons, without realizing that the wall is a load bearing wall, the structure that was supported by the wall can fail leading to severe injury to themselves and/or others and to costly repairs.

SUMMARY OF THE INVENTION

It is the purpose of the present invention to provide a warning sign to be mounted on a load bearing wall, which sign becomes visible when renovation or demolition of the wall begins. The sign will deter the renovator from continuing with the dismantling of the wall until steps are taken to prevent possible damage to the building upon removal of the wall.

In accordance with the present invention a warning sign is provided with the message that the wall the sign appears on is a load bearing wall and that the removal of the wall could cause damage to the building. The sign is adapted to be mounted on the load bearing wall under the outer layer on the wall during the initial construction of the wall. Thus the sign is ordinarily not visible. However when a renovator, in the process of tearing down the wall, removes the outer layer to expose the underlying supporting structure of the wall, the sign, mounted on the supporting structure, becomes visible and warns the renovator about the danger in proceeding.

The sign is big enough to provide space for the message in easy-to-read size. The sign can be made of any suitable material that does not disintegrate with age, such as a metal, plastic, or plastic reinforced paper by way of example. The sign is thin enough so as not to cause a noticeable bulge in the outer layer of the wall. The sign can be mounted on the wall in any manner, but firmly enough so that it is not dislodged during removal of the outer layer. The sign could be mounted on the interior supporting structure of the wall, at around eye level, with adhesive, fasteners, or prongs formed in the body of the sign.

The invention is particularly directed to a warning sign for attachment to the interior supporting structure of a load bearing wall in a building, the sign being mounted on the supporting structure before it is covered with an outer layer of material so that the sign is not normally visible, the sign becoming visible only on removal of the outer layer. The sign has a message on one side, visible to the viewer when the outer layer is removed, warning the viewer that the wall the sign is mounted on is a load bearing wall.

The invention is also directed toward a load bearing wall having the sign mounted therein. The invention is further directed toward the use of the sign with the wall.

DETAILED DESCRIPTION OF THE INVENTION

Figure 1:
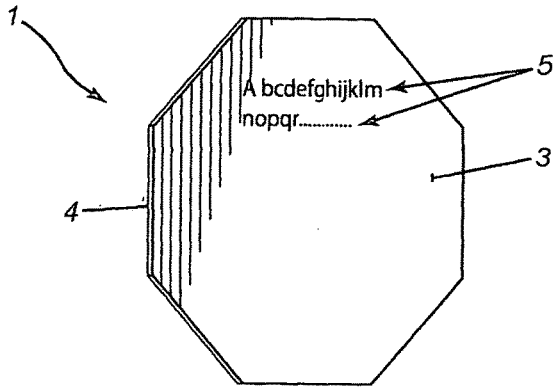
FIG. 1 is front view of the sign.

The warning sign 1, as shown in FIG. 1 is a thin, flat piece of material, preferably rigid enough to keep its shape. The sign 1 is essentially two dimensional with a viewing surface 3 on one side and a mounting surface 4 on the opposite side. The sign can be made from one, or a combination, of various materials such as metal, plastic, or reinforced paper. The sign can be made in one of various shapes such as round, square, rectangular, hexagonal, or, preferably, octagonal to mimic the outline of a traffic stop sign. The sign 1 would be large enough to have a warning message 5, on the viewing surface 3 of the sign, in letters large enough to be easily read by a person a step or two away from the sign. The sign could be about six inches wide to carry the message. The message 5 could be printed, stamped, painted, embossed or otherwise affixed to the viewing surface 3 of the sign. The background of the front of the sign could be coloured red, which colour implies danger, or yellow, which colour implies caution. An octagonal, red sign would emphasize the warning message 5 that the sign carries.

Figure 2:
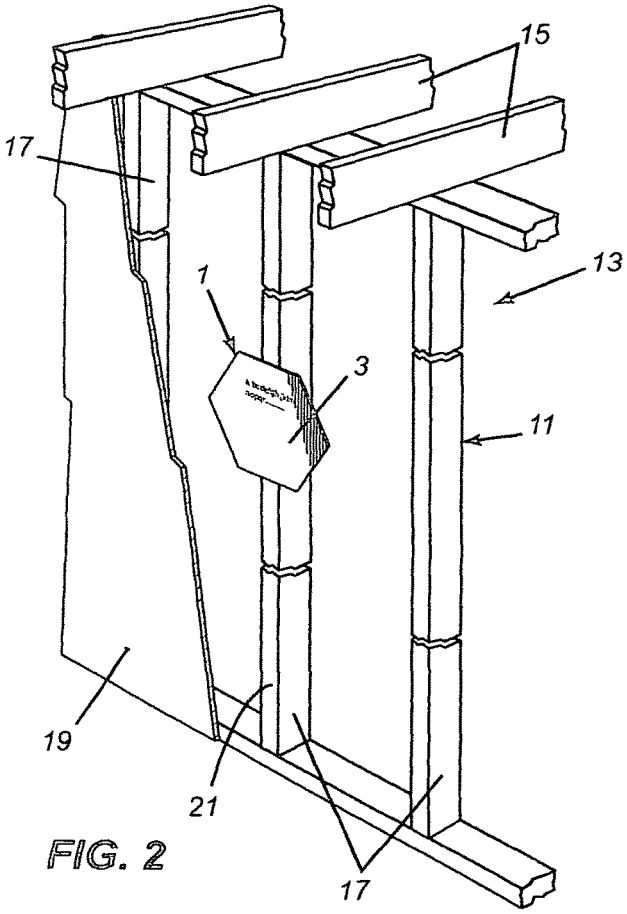
FIG. 2 is a perspective view of the sign mounted on a load bearing wall of a building.

The sign 1 is adapted to be mounted on the interior supporting structure 11 of a load bearing wall 13 in a building during construction of the building as shown in FIG. 2. The building is usually a residential structure and the interior supporting structure of the wall is usually wood framing. The load bearing wall 13 is a wall that supports a structural load such as the roof or ceiling joists 15. If the wall 13 is removed, the roof or ceiling joists 15 could collapse. The supporting structure 11 of the wall is typically a framework of wood using 2×4's or 2×6's as the vertical studs 17. However the supporting structure 11 could also be made of other materials such as a metal framework with metal studs, or a masonary structure, made of cinder blocks or the like. Once the supporting structure 11 is complete, it is covered with an outer layer 19 of finishing material. The outer layer 19 is usually a gypsum board applied in panels or sections to cover the supporting structure and provide a surface for paint, wallpaper and the like. Other known materials can be used for the outer layer in place of the gypsum board.

The warning sign 1 is attached to the supporting structure 11 of the load bearing wall 13 before the outer layer 19 is applied. The sign 1 is preferably attached to the edge 21 of one of the studs 17 so it will be parallel to the outer layer 19. The message 5 on the viewing surface 3 of the sign will face out from the supporting structure 11.

Figure 3:
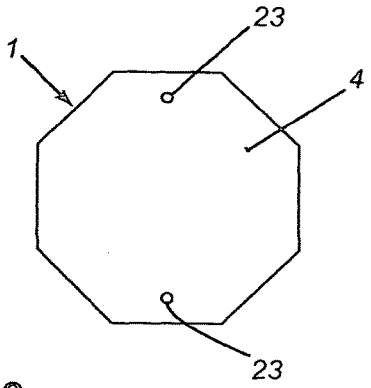
FIG. 3 is a rear view of a modified sign.
Figure 4:
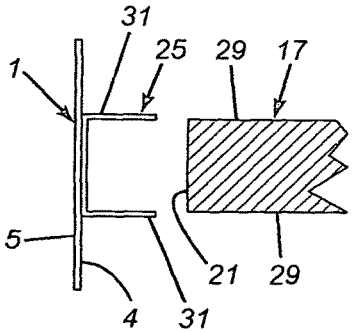
FIG. 4 is a perspective view of another modified sign.
Figure 5:
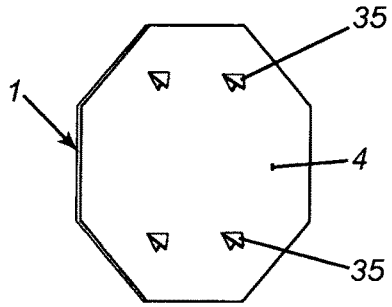
FIG. 5 is a perspective view of yet another modified sign.

The sign 1 can be attached in one of several ways. It could be glued on or attached with fasteners such as one or more nails or screws. If attached with fasteners the sign 1 could have attachment holes 23 already formed in it to receive the fasteners as shown in FIG. 3. The sign 1 could be provided with a u-shaped channel section 25 on its mounting surface 4, as shown in FIG. 4. The channel section 25 slips over the edge 21 of a stud 17, the channel section 25 then nailed to the sides 29 of the stud 17 through the side walls 31 of the channel section. If the sign 1 is made of metal, it could have teeth 35 stamped out of it and bent to be perpendicular to the mounting surface 4 of the sign, as shown in FIG. 5. The teeth 35 extend rearwardly from the mounting surface 4 of the sign 1 and are adapted to be driven into the edge of the stud. If the supporting structure is masonary the sign could be bent to provide a small section perpendicular to the rest of the sign and extending rearwardly from the sign. The bent section would be attached, during construction of the wall, in the cement holding the masonary members together with the main body of the sign flat against the wall. Once the sign 1 is applied to the wall, it is covered up with the outer layer 19. The sign 1 is thin enough that it does not noticeably deform the outer layer 19.

As is apparent from above, the method of installing the sign involves the steps of first constructing the supporting structure of the load bearing wall; then affixing one or more of the warning signs to each side of the supporting structure; and finally, covering up the supporting structure, including covering the warning signs on the supporting structure, with a finishing cover layer.

The sign has been described as being attached to the supporting structure to a single stud on the edge of the stud. The sign could also be attached to the supporting structure in other ways. The sign could, for example, be made long enough to extend between two adjacent studs and attached to both studs. Alternatively, the sign could be mounted on the back of a thin, narrow strap which extends between, and is fastened to, the edges of two adjacent studs. The message on the side of the sign facing outwardly would be located on the front, or viewing face of the sign in a manner so that it is not covered, even in part, by the strap. The sign could also be attached to the side of a stud, spaced inwardly from the outer covering layers.

Figure 6:
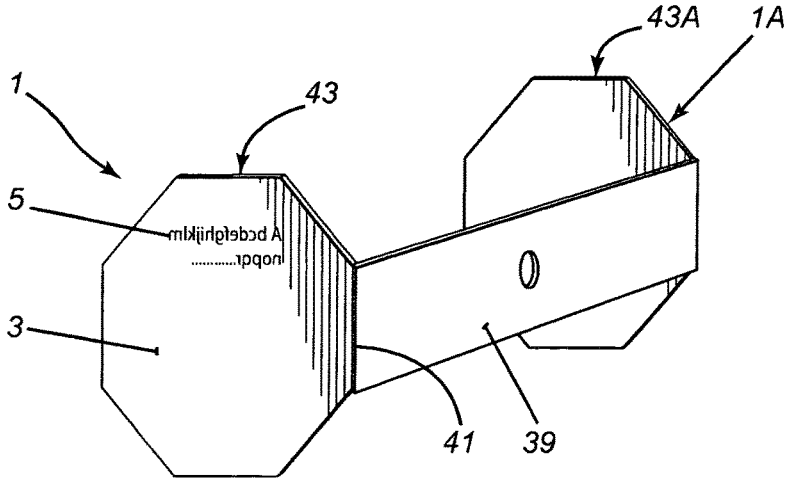
FIG. 6 is a perspective view of yet another modified sign.
Figure 7:
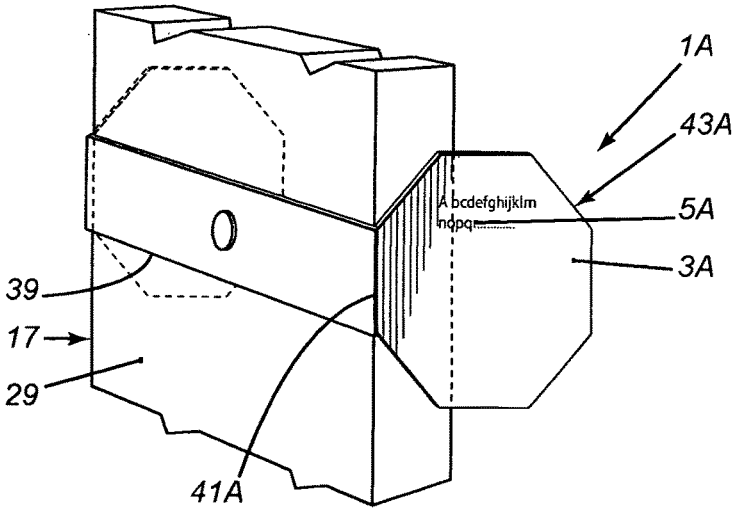
FIG. 7 is a perspective view of the modified sign of FIG. 6 when installed on a load bearing wall.

In another embodiment, as shown in FIGS. 6 and 7, the first warning sign 1 could be provided with a second identical warning sign 1A, the two signs 1, 1A joined by a connector 39. The signs 1, 1A are parallel, transverse to the connector 39, and spaced apart by the connector 39 a distance equal to the width of the wide side 29 of a stud 17 used in the load bearing wall. Each sign would be the same as the sign described above and shown in FIG. 1. The two signs 1, 1A would have their viewing surfaces 3, 3A, with the warning message 5, 5A thereon, facing outwardly away from each other. The signs 1, 1A would preferably be octagonal in shape, although they could have other shapes, and the connector 39 would extend between vertical sections 41, 41A of the peripheral edge 43, 43A of the signs.

The connector 39 is sized to be as long as the width of the side 29 of the stud 17 the signs are to be mounted on. Placing the connector 39 against the side 29 of the stud, locates the two signs 1, 1A against the two edges 21 of the stud 17. A fastener (not shown) through the connector 39 into the stud 17, or one or more fasteners (not shown) through the sign or signs into the stud, retains both signs on the stud, one on each side of the wall.

The message 5 on the sign is one which warns the viewer directly or indirectly that the wall the sign is affixed to, is a load bearing wall. The sign can further include the information that the removal of the wall could damage the building. The sign could advise the viewer to seek professional help to deal with the wall. The message on the sign could be simple or detailed. The main idea to be conveyed by the message however is to warn the viewer that the wall the sign is on is a load bearing wall and that the wall's removal could have dangerous consequences.

With the sign installed, if the building owner decides to renovate and his renovation plans, because of his lack of knowledge of building structures, calls for the removal of a load bearing wall in the building, the removal of the outer layer 19 of the wall 13 will reveal the warning sign 1 so that the renovator can stop and get help to decide what to do with the bearing wall before continuing and possibly severely injuring someone and/or damaging the building.

Each load bearing wall in a building can have several signs on each side of the wall, the signs normally being at about eye-level and spaced about four feet apart. The loading bearing wall can be a complete wall forming one side of a room, or just a partial wall extending from one wall into a large room. The load bearing wall could even comprise one or more aligned, spaced-apart columns.

I claim:

1. A load bearing wall in a building, the wall having an inner supporting structure, the inner structure covered with an outer layer; at least one warning sign for mounting solely on a load bearing wall, the warning sign being a single, essentially two dimensional, member having a viewing surface on one side with a warning thereon relevant to a load bearing wall, and a mounting surface on the other side; the warning sign mounted on the inner structure of the load bearing wall in the building with the mounting surface of the sign against the inner structure and parallel to the wall; the outer layer covering the inner structure and lying against the viewing surface of the sign; the sign covered by the outer layer and not visible and thus not in use; the sign becoming visible and thus in use, so that the warning on the viewing surface can be read, if the outer layer is completely removed off the sign.

2. A load bearing wall as claimed in claim 1 wherein the inner supporting structure has a plurality of spaced-apart vertical studs, each stud, as seen in cross-section, having a pair of opposed wide sides joined by a pair of opposed narrow sides, the sign generally centrally mounted on a narrow side of one of the studs.

3. A load bearing wall as claimed in claim 2 including attachment means on the sign for use in attaching the sign to the narrow side of said one stud.

4. A load bearing wall as claimed in claim 3 wherein the attachment means comprises at least one hole in the sign for receiving a fastener.

5. A load bearing wall as claimed in claim 3 wherein the attachment means has u-shaped channel fastened to the other side of the sign, the channel adapted to be slipped onto the said one stud over its facing edge, the channel fastened to the stud with fastening means.

6. A load bearing wall as claimed in claim 3 wherein the attachment means comprises teeth formed from the sign to extend from the other side of the sign opposite to the one side carrying the message, the teeth penetrating the facing edge of the said one wall.

* * * * *